United States Patent [19]

Lemelson

[11] 4,106,153

[45] Aug. 15, 1978

[54] CLEANING APPLIANCE

[76] Inventor: Jerome H. Lemelson, 85 Rector St., Metuchen, N.J. 08840

[21] Appl. No.: 781,137

[22] Filed: Mar. 25, 1977

Related U.S. Application Data

[63] Continuation-in-part of Ser. No. 596,052, Jul. 15, 1975, abandoned.

[51] Int. Cl.[2] ..... A47L 13/20

[52] U.S. Cl. ..... 15/231

[58] Field of Search ..... 401/205, 206, 207; 15/228, 231, 232

[56] References Cited

U.S. PATENT DOCUMENTS

| | | | |
|---|---|---|---|
| 2,902,395 | 9/1959 | Hirschy et al. | 15/209 R X |
| 3,012,264 | 12/1961 | Nash | 15/231 |
| 3,629,048 | 12/1971 | Davison | 15/209 R X |
| 3,641,612 | 2/1972 | Clurman et al. | 15/231 |

FOREIGN PATENT DOCUMENTS

| | | | |
|---|---|---|---|
| 978,796 | 12/1964 | United Kingdom | 401/205 |

*Primary Examiner*—Daniel Blum

[57] ABSTRACT

An appliance is provided which may be utilized to wipe clean a surface. The appliance contains a handle and a frame such as a yoke or otherwise shaped holding unit for a flexible member such as sponge or cellular plastic member or otherwise shaped flexible unit. A sheet-like material such as or filament-reinforced absorbent paper is fed from a roll supply thereof supported by the support for the appliance, around the flexible portion of the appliance and held against a frame or retaining unit. Thus, as each section of the sheet or paper is soiled or used up, a new section thereof may be easily fed across the face of the flexible unit and retained in place.

1 Claim, 3 Drawing Figures

CLEANING APPLIANCE

RELATED APPLICATIONS

This application is a continuation-in-part application of application Ser. No. 596,052, filed July 15, 1975, now abandoned for Cleaning Appliance.

SUMMARY OF THE INVENTION

This invention relates to a cleaning implement which is particularly applicable for the cleaning of floors and woodwork and may also be utilized for wax applying and polishing purposes.

A variety of cleaning and wiping devices have been developed and used to clean surfaces. These have included mops employing multiple strands of stringy water absorbing material, devices employing water absorbing sponges and a variety of other devices which are supported at the end of a rod or handle and are moved against and across a surface such as the floor in a wiping action. Most of these devices suffer the shortcoming that the wiping element, which is generally a textile material, string or plastic sponge, soon becomes contaminated and soiled with dirt and its effectiveness is rapidly reduced, even after soaking in water, thus requiring its replacement after a certain amount of use.

The instant invention employs a surface cleaning and wiping element such as a sheet of textile material or reinforced paper which may easily be applied and replaced with respect to a working head disposed at the end of a handle so that when the wiping element wears out or becomes too contaminated for proper use, it may easily be replenished with a fresh section thereof.

Accordingly, it is a primary object of this invention to provide a new and improved cleaning and wiping device for use on surfaces such as floors, walls and other structures.

Another object is to provide a cleaning and wiping device having a flexible sheet-like cleaning element which may be easily replaced thereon.

Another object is to provide a cleaning and wiping device containing a supply of a flexible sheet-like cleaning element from which supply sections of the element may be easily moved and disposed in operative relation with a cleaning head forming part of the device.

With the above and such other objects in view as may hereafter more fully appear from reading the following specification and studying the accompanying drawings, the invention consists of the novel constructions, combinations and arrangements of parts set forth but it is to be understood that changes and variations may be resorted to which come within the purview of the accompanying claims without departing from the spirit and nature of the invention.

In the Drawings

Figure 1:
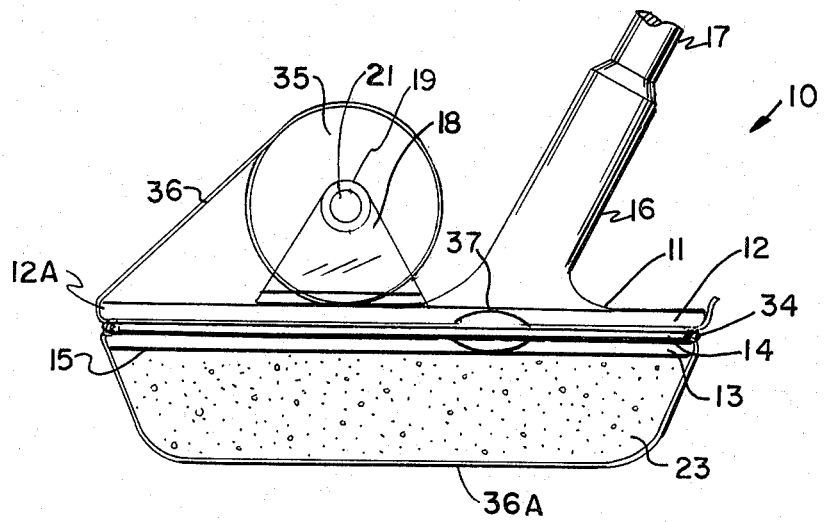
FIG. 1 is a side elevation view of a cleaning appliance embodying the present invention.

In FIG. 1 is shown an appliance 10 which may be used for floor and wall cleaning operations or polishing operations. The appliance 10 comprises a support 11 for a roll 35 of sheet material 36 such as paper, filament reinforced paper, cloth, plastic film or other suitable material which may be used for wiping, buffing, water absorption or cleaning purposes.

The support 11 is preferably, although not necessarily, molded of a rigid plastic, such as polystyrene, cellulose acetate, polypropylene or other suitable plastic, and includes a rectangular base portion 12 having a tubular retaining portion 16 which is centrally located with respect to the sides of the base portion 12 and is integrally molded therewith. The tubular portion 16 supports an elongated handle 17 in the form of a rod or dowel which may vary from a foot or two in length to between 3 and 5 feet depending on whether it is desired to utilize the appliance 10 for a table or wall wiping device or a floor wiping device.

The base 12 supports a slab-like formation 23 of flexible cellular plastic such as polyurethane, polyvinyl chloride, cellulose acetate, or other suitable foam plastic material which may serve both as a cushion for a portion of the sheet material 36 which is wrapped therearound, as illustrated, and as a supply reservoir for a small quantity of cleaning fluid, water, wax, or other material which may be desired to be dispensed therefrom through the sheet material 36 depending on the characteristics of the latter and the nature of the operation to be performed by the appliance. For example, if sheet material 36 is a porous cloth or non-woven fabric, or perhaps even filament reinforced paper, liquid material stored within the cellular material 23 may be forced through the pores of the sheet as the appliance is pressed against a surface and used for cleaning or polishing purposes. However, for most applications where sheet material 36 is a paper product, it may be desirable not to permit the flexible, cellular material 23 to absorb any liquid as this may tend to degrade or destroy sheet material 36 disposed thereagainst.

Roll 35 of sheet material 36 is supported at both ends by respective brackets, one of which 18 is shown in FIG. 1 and is located at one side of the base 12. The bracket 18 contains a bearing portion 19 formed at the upper end thereof for supporting a rod or shaft 21 extending completely through the roll 35 and supported at its other end by a similar bracket mounted on the upper surface of base 12. The sheet material feeds from the roll 35 downwardly and over the rounded front end portion 12A of base 12 and around the lower rim 13 of the base, then downwardly and around the tapered front wall of the flexible support 23, backwardly along the bottom face of 23, upwardly around the tapered rear wall of 23 and then back up against the rear wall of base 12. The side wall of base 12 tapers downwardly and contains a circumscribing indentation 14 between the lower portion 12 of the base and the upper portion thereof. The sheet 36 is held firmly against the tapered surfaces of the cellular plastic slab 23 by means of a rectangular wire or plastic ring 34 which is pushed upwardly against the tapered circumscribing wall and forces portions of sheet material into the groove or channel 14 formed in the side wall 12, as illustrated. When the sheet material 36A extending across the cellular plastic support 23 is worn or too contaminated to continue its use, the ring 34 is forced out of the groove 14, by urging a tool such as a screw driver into a recess 37 which extends from the groove and permits the tool to be forced beneath the ring and to urge it outwardly and downwardly by deflection of the ring to permit its removal from the groove.

The interface 15 between the flexible slab 23 and the bottom face of base 12 may contain an adhesive or other suitable means for fastening the flexible material to the base.

Figure 2:
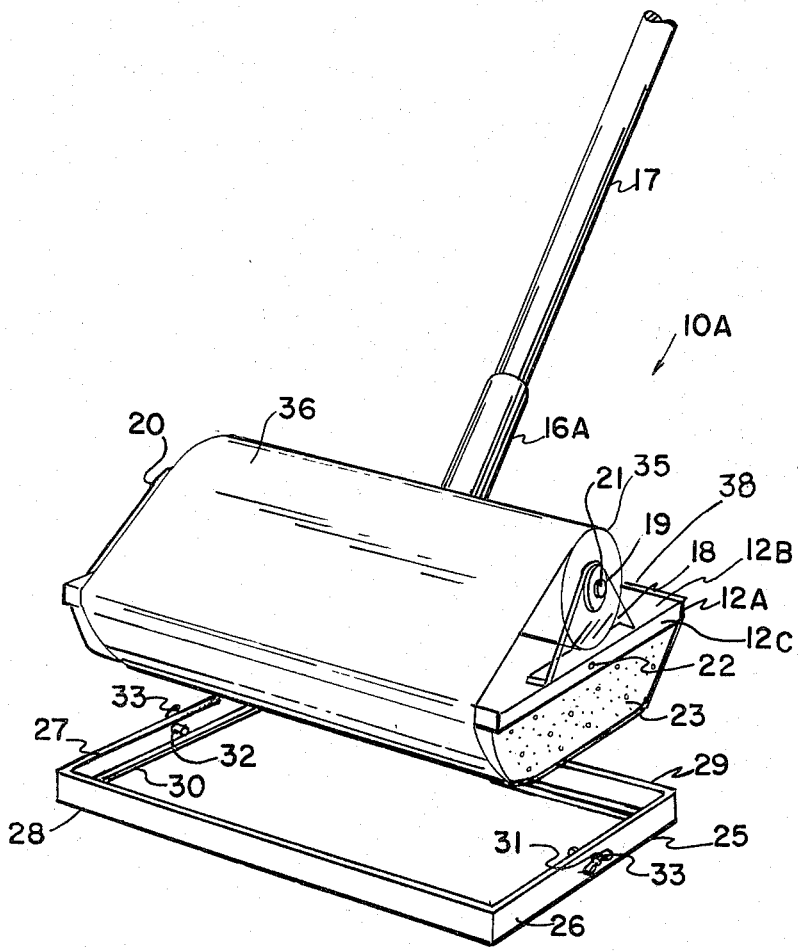
FIG. 2 is a perspective view of a modified embodiment of a cleaning appliance embodying the invention.

In FIG. 2 is shown a modified cleaning and wiping device 10A having many of the features of FIG. 1 but containing a different means for supporting and securing the flexible sheet material in place. The assembly 10A includes a base 12A which base is rectangular in shape and contains a flat upper wall 12B and a circumscribing side wall 12C, preferably injection molded of rigid plastic, as described, with a handle retaining tubular portion 16A molded thereon and extending upwardly and rearwardly therefrom for supportng an elongated rod-like handle 17.

Supported at the sides of the base 12 and preferably molded integral with the upper wall 12B thereof are respective bracket formations 18 and 20, each of which contains a bearing or retaining portion 19 near its upper end for rotatably or otherwise supporting a rod 21 or the tubular member on which the coil 35 of sheet material 36 is supported. The support afforded by the brackets 18 and 20 for the coil formation 35 of sheet material 36 is preferably frictional in characteristic so that the sheet material 36 will not easily pay-out therefrom and will be maintained in a tensioned condition as illustrated.

Sheet material 36 is maintained tightly against the front bottom and rear faces of the flexible slab 23 by means of a frame-like retainer 25 of substantially rectangular shape and having vertically extending side walls 26 and 27 connecting strip-like front and rear walls 28 and 29. The lower inside edge of the frame 25 contains an inwardly extending beaded formation 30 which serves to stiffen the frame and also to engage the lower edge of the side wall portion 12C of the base 12A when the frame is pushed upwardly from the position illustrated in FIG. 2 so that the walls 26–29 are aligned with the side wall 12C of base 12A. When such alignment is effected, the inside surfaces of the front and rear walls 28 and 29 of frame 25 frictionally engage the respective aligned portions of sheet material 36 against the front and rear wall portions of the circumscribing side wall 12C of base 12A, retaining the portion of sheet material wrapped around the slab-like, flexible formation 23 in position. The frame 25 may be secured to the base 12A by means of respective wing-screws 33 which pass through holes 31,32 in the side walls 26 and 27 and are retained in threaded holes 22 formed in the aligned portions of the side wall portion 12C of base 12A.

While a supply of sheet material may be most conveniently supported above the base 12 or 12A of FIGS. 1 and 2 and operated to feed fresh portions of the sheet downwardly and around the flexible slab-like formation 23, it is noted that the coil formation and its mount may be eliminated wherein suitable lengths of the flexible material 36 are secured in the positions illustrated in FIGS. 1 and 2 by the means provided therein. Other means may, of course, also be utilized to retain the lengths of sheet material in the positions illustrated, and tightly against the surfaces of the flexible plastic slabs 23 of FIGS. 1 and 2.

Notation 38 in FIG. 2 refers to the upper rear edge of the base 12 which may either be molded with a tooth-like serration therein or may contain a toothed blade attached thereto to facilitate the tearing off of the old section of sheet material after it is replaced by a new section across the flexible slab-lie formation 23. Other means than shown may also be employed to clampingly engage the sheet material 36 against the base 12 and across slab 23.

Figure 3:
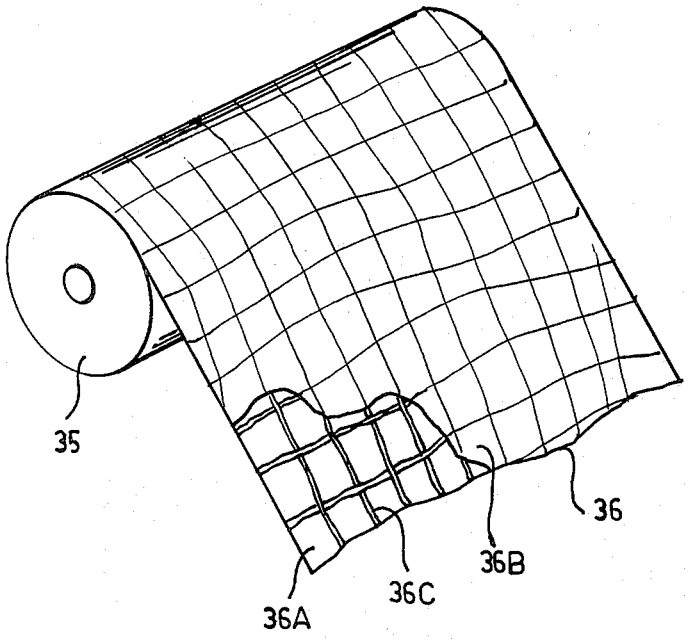
FIG. 3 is an illustration of a detail of construction.

FIG. 3 illustrates roll 35 in detail. The sheet 36 of roll 35 comprises fiber reinforced paper of absorbent material. The sheet material may be formed of laminated layers 36A, 36B with the reinforcement fibers 36C disposed between layers 36A, 36B. It will be understood that the layers 36A, 36B may be suitably bonded or otherwise adhered to sandwich the fibers 36C therebetween.

The sheet material 36 may be formed as a press sheet material with the fibers secured to one side thereof.

While the invention has been described with respect to several embodiments thereof, it will be appreciated that variations and modifications may be made without departing from the spirit or scope of the invention.

What is claimed is:

1. A cleaning and wiping appliance comprising:

a cleaning head having a substantially rectangular support having a base portion, said base portion having a flat upper surface and circumscribing walls including front, rear, and connecting side walls formed of a rigid plastic material, said side walls defining opposed edge portions, a handle retaining means on said flat upper wall, an elongated handle secured to said handle retaining means, a flexible foam slab connected to the under surface of said base portion, said flexible foam slab being confined within the perimeter defined by said circumscribing walls, a pair of opposed brackets connected to said flat upper surface in opposed spaced apart relationship, said brackets extending upwardly above said upper surface, and said brackets having bearing portions defined thereby, a shaft means supported between the bearing portions of said brackets, a roll of fiber reinforced absorbant paper supported on said shaft to permit the free end of said paper to be played out from said roll and threaded about said slab, said reinforced paper including reinforcing fibers extending transversely and longitudinally of said paper to form an lattice reinforcement for said paper, said slab defining a resilient backing for said fiber reinforced paper, and said roll of paper being remotely disposed from the floor area to be cleaned, said brackets frictionally engaging the ends of said roll of paper for maintaining said paper tensioned, retaining means to fixedly secure said fiber reinforced paper about said slab by clampingly engaging spaced apart portions of said fiber reinforced paper so as to retain said fiber reinforced paper in place over said slab when the cleaning head is disposed against a surface to be wiped or mopped with said fiber reinforced paper, said retaining means including a circumscribing, rectangular frame member for snugly embracing said front and rear walls of said base portion whereby said fiber reinforced paper is clamped in position between said front and rear walls and said circumscribing member, and means for releaseably securing said circumscribing member to said base portion whereby said member is displaced relative to said front and rear walls to facilitate the drawing of said fiber reinforced paper over said slab so that a clean section of said paper can be substituted for a preceeding soiled portion of said paper.

* * * * *